US005901700A

United States Patent [19]

Suzuki et al.

[11] Patent Number: 5,901,700

[45] Date of Patent: May 11, 1999

[54] COMBUSTION APPARATUS

[75] Inventors: Jiro Suzuki, Nara; Takeshi Tomizawa, Ikoma; Tatsuo Fujita, Osaka; Yutaka Yoshida, Nabari; Norio Yoshida, Moriyama; Kunihiro Ukai, Ikoma; Katsuyuki Ohara, Katano, all of Japan

[73] Assignee: Matsushita Electric Industrial, Co. Ltd., Osaka, Japan

[21] Appl. No.: 08/823,619

[22] Filed: Mar. 25, 1997

[30] Foreign Application Priority Data

Mar. 25, 1996 [JP] Japan ..... 8-068699
Sep. 5, 1996 [JP] Japan ..... 8-235552

[51] Int. Cl.[6] ..... F24H 1/00

[52] U.S. Cl. ..... 126/350 R; 431/7; 431/328

[58] Field of Search ..... 431/7, 328; 126/350 R

[56] References Cited

U.S. PATENT DOCUMENTS 3,672,839 6/1972 Moore ..... 431/328
4,459,126 7/1984 Krill et al. ..... 431/7
5,320,518 6/1994 Stilger et al. ..... 431/7

FOREIGN PATENT DOCUMENTS 7-316888 12/1995 Japan .
8-68513 3/1996 Japan .

*Primary Examiner*—Carroll B. Dority
*Attorney, Agent, or Firm*—Ratner & Prestia

[57] ABSTRACT

A combustion apparatus has a fuel feed unit, a blower for supplying combustion air, a mixing unit of fuel and combustion air, a first catalyst provided downstream of the mixing unit, a first heat receiving unit adjacent to the first catalyst, a second catalyst with a large geometrical surface area than that of the first catalyst provided downstream in the flow direction of the first catalyst, an electric heater for heating the catalyst provided downstream of the second catalyst, an air permeable insulator provided downstream of the electric heater, and a second heat receiving unit provided downstream of the air permeable insulator, wherein power is supplied to the electric heater when starting combustion to heat the second catalyst over the reaction temperature of catalyst, a mixed gas of fuel and air is fed to start catalytic combustion of second catalyst, the downstream portion in flow direction of the first catalyst is heated over the reaction temperature of catalyst by the combustion heat of the second catalyst, and combustion is started by the first catalyst.

30 Claims, 6 Drawing Sheets

COMBUSTION APPARATUS

BACKGROUND OF THE INVENTION

1. Field of the Invention

The present invention relates to a combustion apparatus used in heater, water heater, air conditioner or the like, using combustion heat as heat source.

2. Related Art of the Invention

When a catalytic combustion apparatus is operated at a same combustion load factor (combustion amount per unit volume of combustion chamber) as in a flame combustion apparatus, the catalyst temperature exceeds 1200° C., and the heat resistant life of the catalyst is extremely shortened. As means for solving this problem of combustion load factor, for example, as shown in an embodiment of Japanese Patent Application No. 7-316888 in FIG. 1, a combustion system is composed of a first catalytic combustion unit 1 having a heat exchange type, and a second catalytic combustion unit 2 having a honeycomb catalyst provided downstream of the first catalytic combustion unit 1. The fuel is mainly burned in the first catalytic combustion unit 1, and a flame is not formed at its downstream. The first catalytic combustion unit 1 makes use of high heat transfer property of catalytic combustion, and is a heat exchange type catalytic combustion unit having a catalyst 4 provided in a heat receiving fin 3. The water in a cooling route 6 is heated to be warm water in the first catalytic combustion unit and waste heat recovery unit 7. Since the heat receiving fin 3 for heat exchange is directly covered with the catalyst 4, the heat transfer speed of the heat generated in the catalyst to the heat receiving fin is high, so that a combustion system integrated with heat exchanger of small size and high efficiency is realized.

To start combustion in this system, the catalyst must be preheated over the reaction temperature. As this combustion starting method, a method of forming a flame before start of catalytic combustion, and a method of preheating the first catalytic combustion unit 1 second catalytic combustion unit 2 before start of catalytic combustion by electric heater 5 have been proposed.

Such conventional systems, however, involve three problems as explained below.

1. Concerning start of combustion, a method of heating the catalyst to activation temperature by an electric heater, and then feeding fuel is disclosed as a prior art. In this prior art, the electric heater heats all of first catalyst, heat exchanger of first catalyst, and second catalyst, and therefore a large electric power was required for heating the catalyst. A method of preheating by flame is also disclosed, and although the required electric power is small in this method, NOx is contained in the exhaust generated by the flame.

2. Concerning the structure of the heat exchanger of the first catalytic combustion chamber, in the prior art, the heat exchanger fin of the first catalyst projects from the periphery into the center, and therefore the temperature of the first catalyst is not uniform. As a result, the reaction quantity is not same between the center and periphery of the first catalyst, and it leads to various problems such as deterioration of center of the first catalyst due to elevation of temperature, increase of nonreacted amount due to decline of temperature in the periphery, and reaction of the nonreacted portion of the periphery with the periphery of the second catalyst not having heat receiving portion to deteriorate by causing abnormal high temperature.

3. Concerning combustion adjusting width, in the prior art, when the first catalyst drops in temperature to stop reaction when the combustion amount is extremely small, combustion cannot be started again at this point. Hence, the TDR was not sufficiently wide.

In other conventional heating apparatus, in electric heating, when a large current is generated, the cost of the equipment and the running expense increase, whereas, in combustion heating, a large amount of heat can be generated economically, but there are problems of smell of exhaust, in particular, release of smell when igniting, and instability of combustion in small combustion region. Moreover, in the equipment combining combustion and electric heater, the problem of exhaust of combustion is not solved.

SUMMARY OF THE INVENTION

It is hence an object of the present invention, in the light of the problems of the conventional catalytic combustion apparatuses, to present a catalytic combustion apparatus capable of 1. saving the electric power for preheating the catalyst concerning start of combustion, 2. solving the problems of deterioration of center of the first catalyst due to elevation of temperature, increase of nonreacted amount due to decline of temperature in the periphery, and reaction of the nonreacted portion of the periphery with the second catalyst to cause abnormal high temperature, and 3. adjusting the combustion amount in a broad width.

It is also an object of the invention to realize a heating apparatus capable of dealing with wide fluctuations of heating load, or present a heating apparatus capable of generating a high output by combustion when the ambient temperature is low when starting heating, heating by electric heat when the heating load is low, cleaning the exhaust when igniting in combustion, sharing with preheating power source of catalyst in catalytic combustion, and lowering the NOx level.

Means for solving the above problems 1 to 3 are the following.

Concerning start of combustion of problem 1, comprising a fuel feed unit, a blower for supplying combustion air, a mixing unit of fuel and combustion air, a first catalyst provided downstream of the mixing unit, a first heat receiving unit adjacent to the first catalyst, a second catalyst with a large geometrical surface area provided downstream in the flow direction of the first catalyst, an electric heater for heating the catalyst provided downstream of the second catalyst, an air permeable insulator provided downstream of the electric heater, and a second heat receiving unit provided downstream of the air permeable insulator, power is supplied to the electric heater when starting combustion to heat the second catalyst over the reaction temperature of catalyst, a mixed gas of fuel and air is fed to start catalytic combustion of second catalyst, the downstream portion in flow direction of the first catalyst is heated over the reaction temperature of catalyst by the combustion heat of the second catalyst, and combustion is started by the first catalyst.

That is, as compared with the prior art in which the electric heater heated all of the first catalyst, first heat receiving unit of the first catalyst, and the second catalyst, in the invention, the electric heater is used to heat only the second catalyst and the air permeable insulator, so that temperature rise herein is realized by a low electric power. Moreover, when the second catalyst and air permeable insulator are made of ceramics, the heat conductivity is low, and only the surface contacting with the electric heater is heated locally, and it is possible to preheat with a low electric power. In such constitution, when combustion is started after heating the second catalyst by a low electric power, reaction is started by the second catalyst only. When this reaction heat is transmitted to the upstream of the second catalyst, the downstream end of the first catalyst is heated by this radiation heat, thereby starting reaction.

To advance this method further, a method is also proposed to project the downstream end of the first catalyst from the first heat receiving unit toward the second catalyst. The heat of the second catalyst is effectively transmitted to the first catalyst, and the transmitted heat is not consumed by the first heat receiving unit, and therefore the temperature rise of the first catalyst is fast, and the stationary state is reached quickly.

Concerning the structure of the heat exchanger of the first catalytic combustion chamber of problem 2, comprising a fuel feed unit, a blower for supplying combustion air, a mixing unit of fuel and combustion air, a first catalyst provided downstream of the mixing unit, a heat receiving unit adjacent to the first catalyst, and a second catalyst with a larger geometrical surface area than that of the first catalyst provided downstream in the flow direction of the first catalyst, the heat receiving unit is composed of multiple fins and a cooling route penetrating through the fins, and the first catalyst is disposed nearly parallel among the fins.

In this constitution, a route of cooling water is provided in the middle of the combustion chamber. Herein, multiple fins for receiving heat are provided. The first catalyst is inserted among the fins. In the prior art, since heat exchange fins of the first catalyst project from the periphery into the center, the temperature of the first catalyst was not uniform. In this constitution, by contrast, the cooling route is disposed in the center of the combustion chamber in which the temperature is likely to be high, and the fins are projected toward the periphery in which the temperature tends to be low. Since the leading ends of the fins are higher in temperature than in the center, the temperature is not lowered if the outer periphery is cooled, so that the temperature of the first catalyst is uniform. Accordingly, the problem due to local uneven temperature of the first catalyst is solved.

Concerning the combustion adjusting width of problem 3, comprising a fuel feed unit, a blower for supplying combustion air, a mixing unit of fuel and combustion air, a first catalyst provided downstream of the mixing unit, a heat receiving unit adjacent to the first catalyst, and a second catalyst with a larger geometrical surface area than that of the first catalyst provided downstream in the flow direction of the first catalyst, the first catalyst is mainly responsible for combustion in high combustion amount, and the second catalyst is mainly responsible for combustion in low combustion amount.

In this constitution, in low combustion amount, the first catalyst is lowered in temperature and does not react, but all fuel reacts in the second catalysts. Accordingly, even in low combustion amount, the temperature of the second catalyst maintains the reaction temperature. Again, in high combustion amount, the temperature of the adjacent first catalyst is raised by the upstream radiation heat of the second catalyst, and the first catalyst resumes reaction. Thus, using two catalysts of different compositions, by varying the main combustion position depending on the combustion amount, the combustion amount can be adjusted widely.

Moreover, to cope with wide fluctuations of heating load, the invention presents a heating apparatus comprising a fuel feed unit, a blower for supplying combustion air, a mixing unit of fuel and combustion air, a catalyst provided downstream of the mixing unit, an electric heater, and a heat receiving unit, in which the heat receiving unit is heated by the heat generated by the electric heater when the heating amount is small, and the heat receiving unit is heated by catalytic combustion by the catalyst after feeding power to the electric heater when the heating amount is large. Similarly, the invention of the combustion apparatus comprises a fuel feed unit for supplying fuel, a blower for supplying combustion air, a mixing unit for mixing fuel and combustion air, a catalyst provided downstream of the mixing unit, an electric heater, and a heat receiving unit, wherein the electric heater is energized and fuel is supplied when the heating amount is small to burn the catalyst, and the electric heater is energized when the heating amount is larger, then more fuel than in small heating amount is supplied to burn the catalyst, thereby heating the heat receiving unit.

DESCRIPTION OF THE INVENTION

Figure 1:
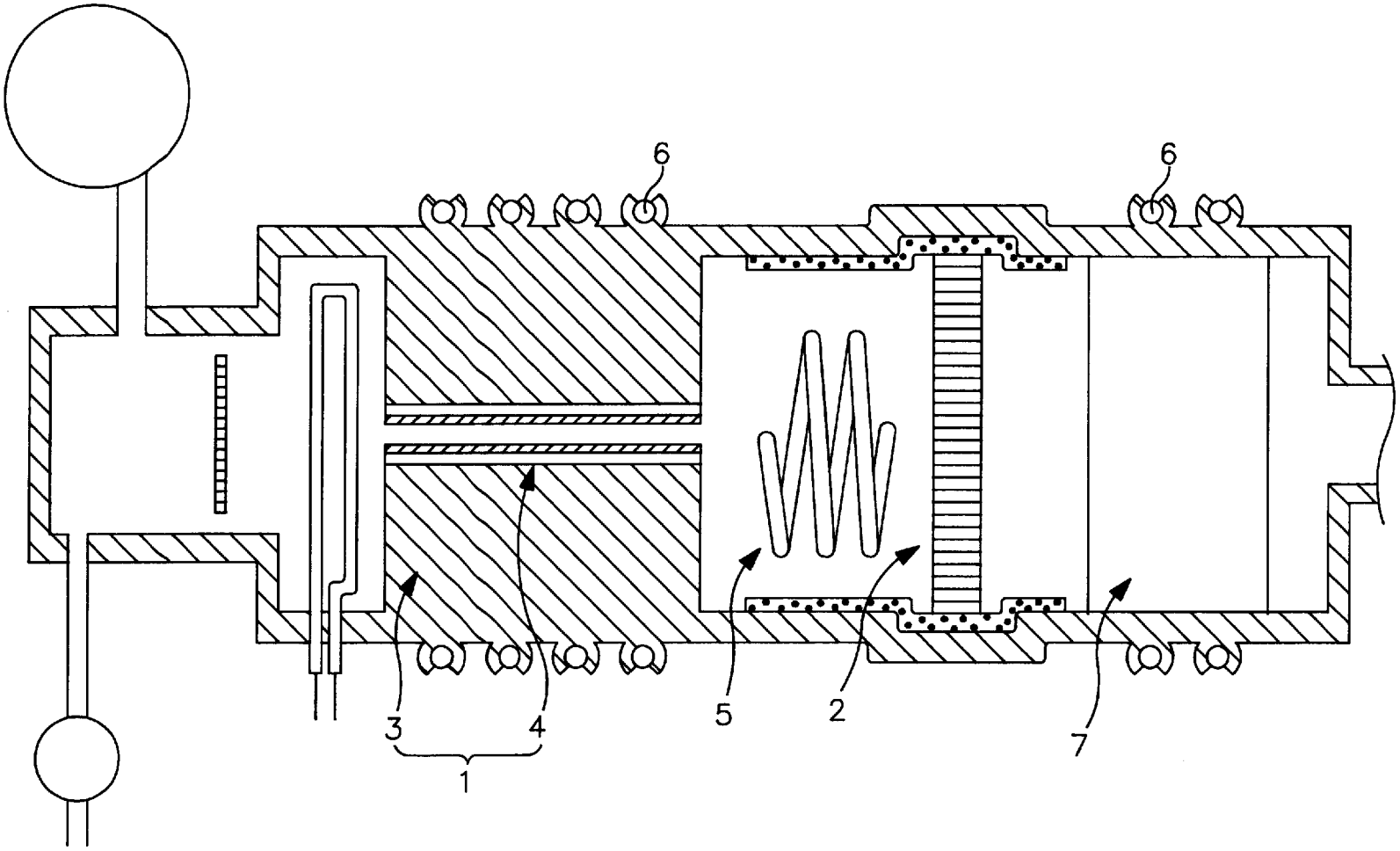
FIG. 1 PRIOR ART
FIG. 1 is a sectional view showing a combustion apparatus in a prior art.
Figure 2:
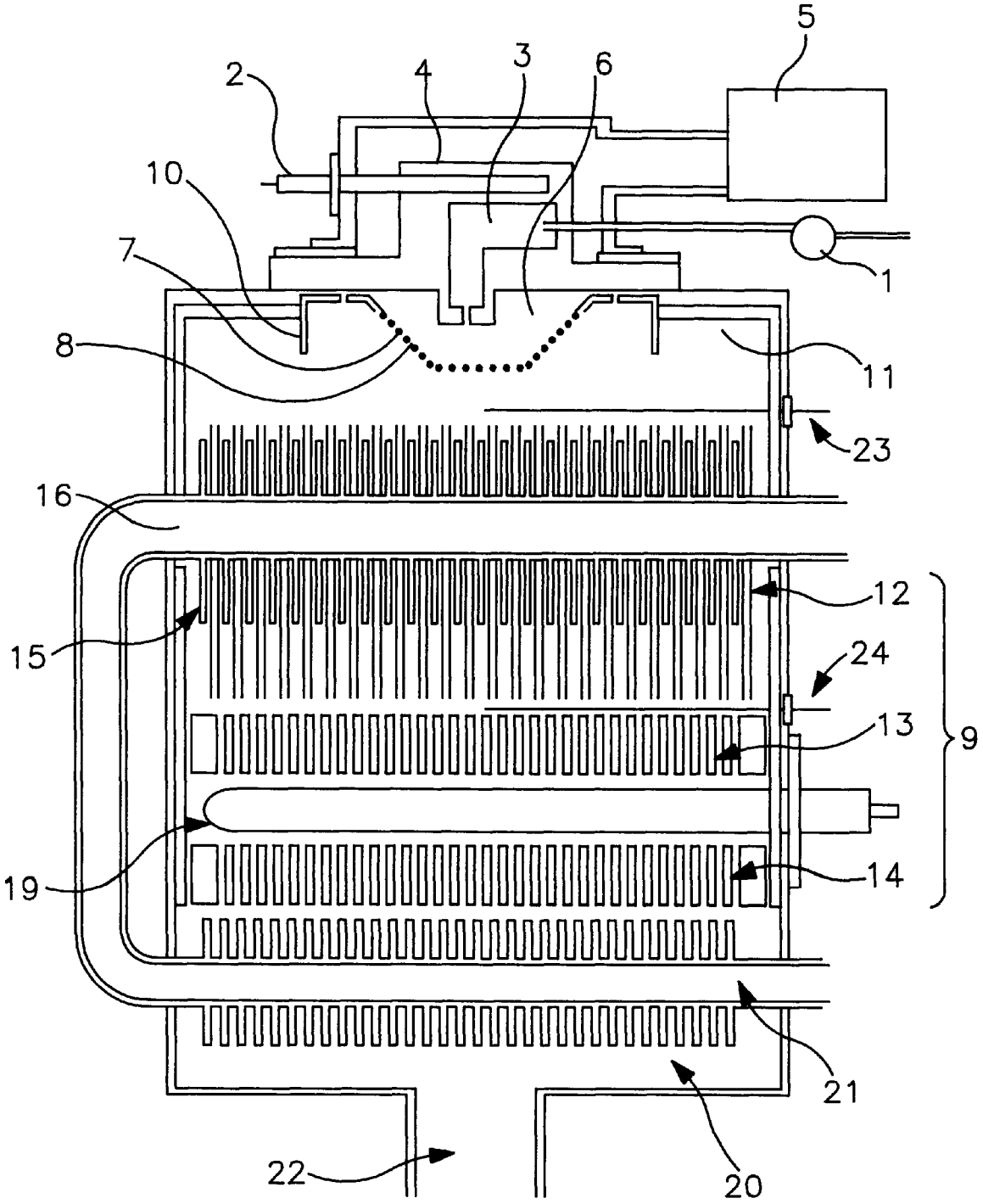
FIG. 2 is a sectional view showing a embodiment of a combustion apparatus of the invention.
Figure 3A:
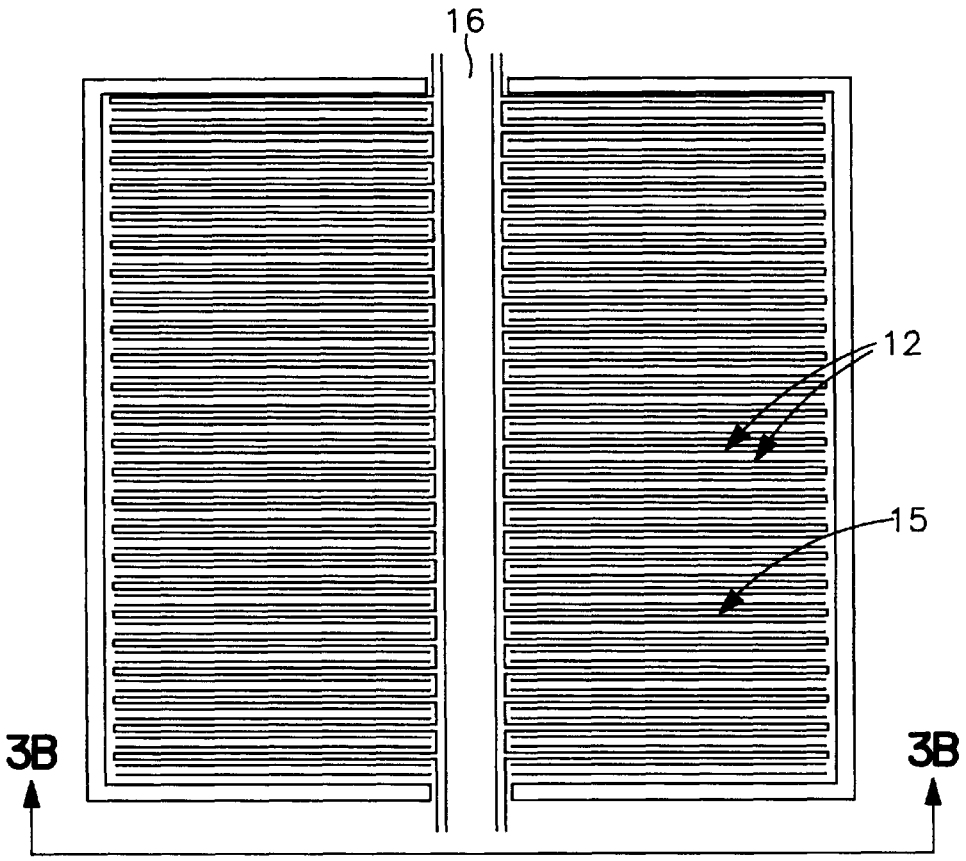

FIG. 3*a* is a detailed drawing of a first catalyst and a first heat receiving unit in FIG. 2.

Figure 3B:
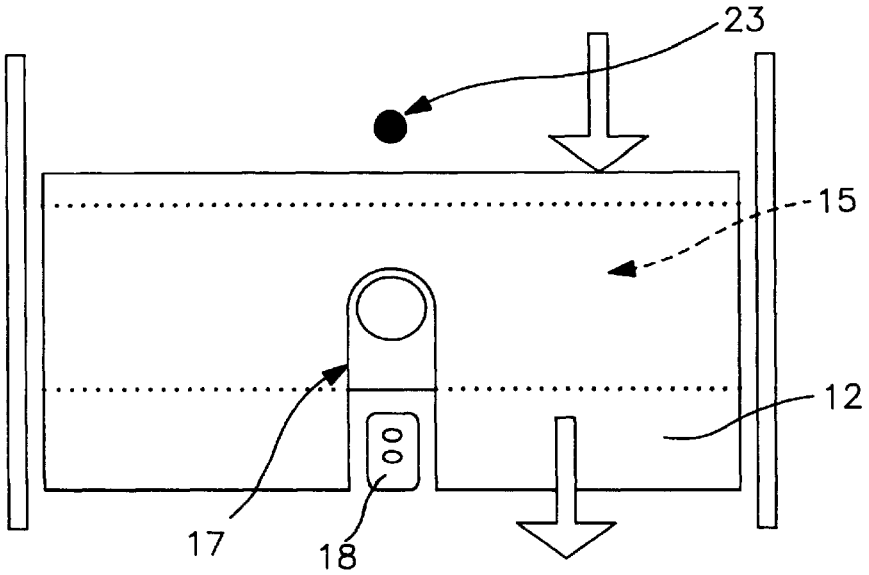

FIG. 3*b* is a view taken along lines 3*b*–3*b* of FIG. 3*a*.

Figure 4A:
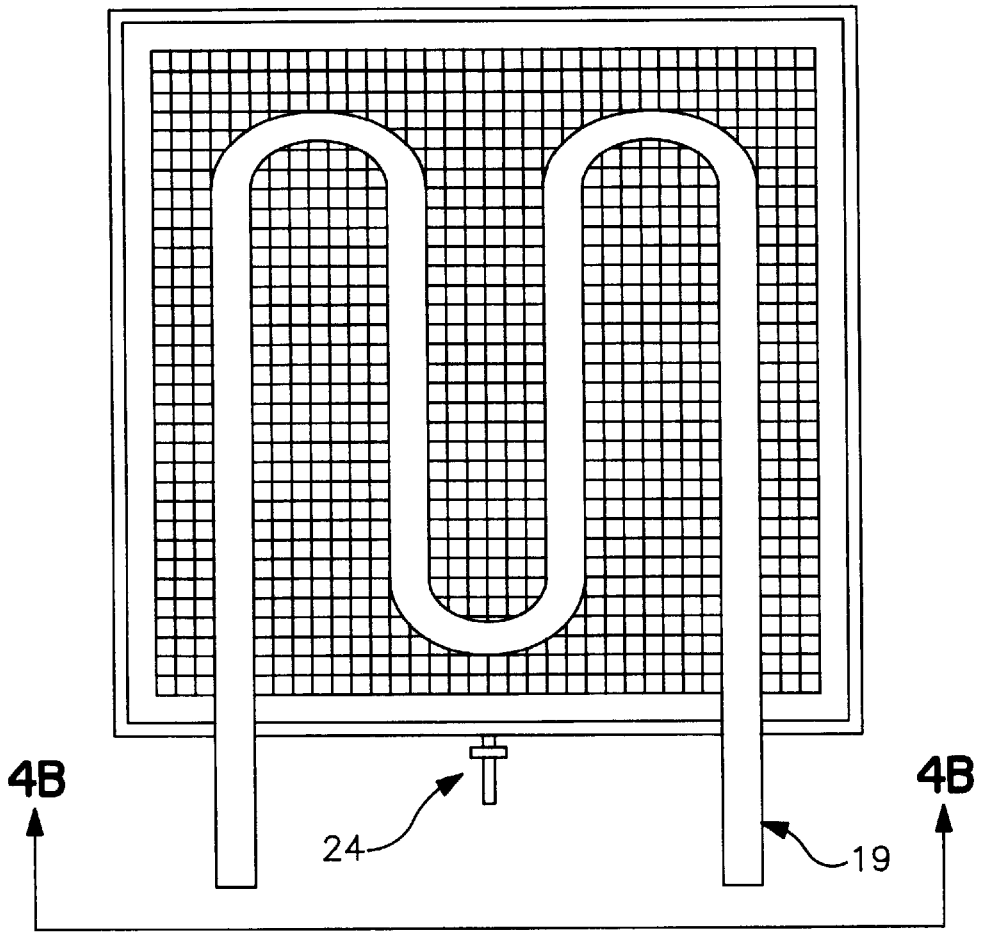

FIG. 4*a* is a detailed drawing of a second catalyst and a third catalyst in FIG. 2.

Figure 4B:
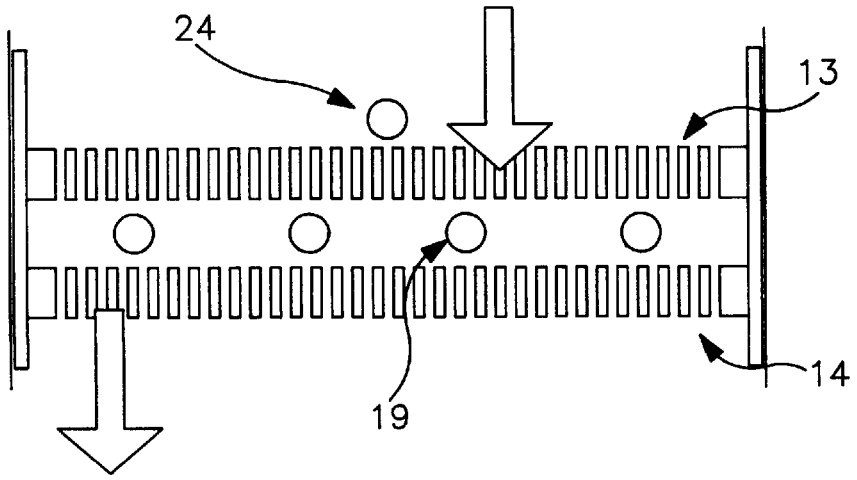

FIG. 4*b* is a view taken along line 4*b*–4*b* of FIG. 4*a*.

Figure 5A:
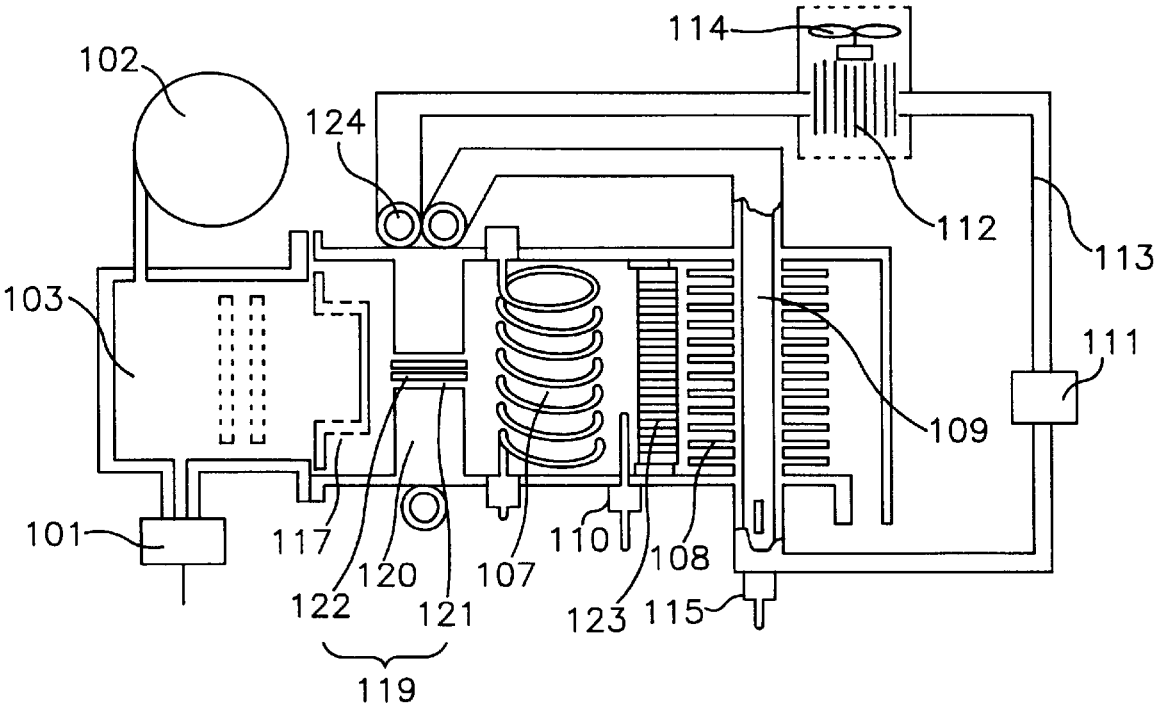
Figure 5B:
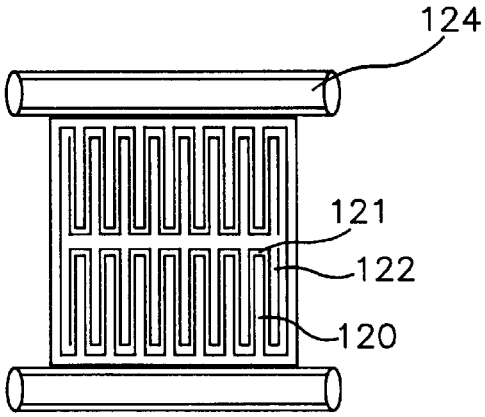

FIGS. 5*a* and 5*b* are sectional views of another embodiment of the invention.

Figure 6:
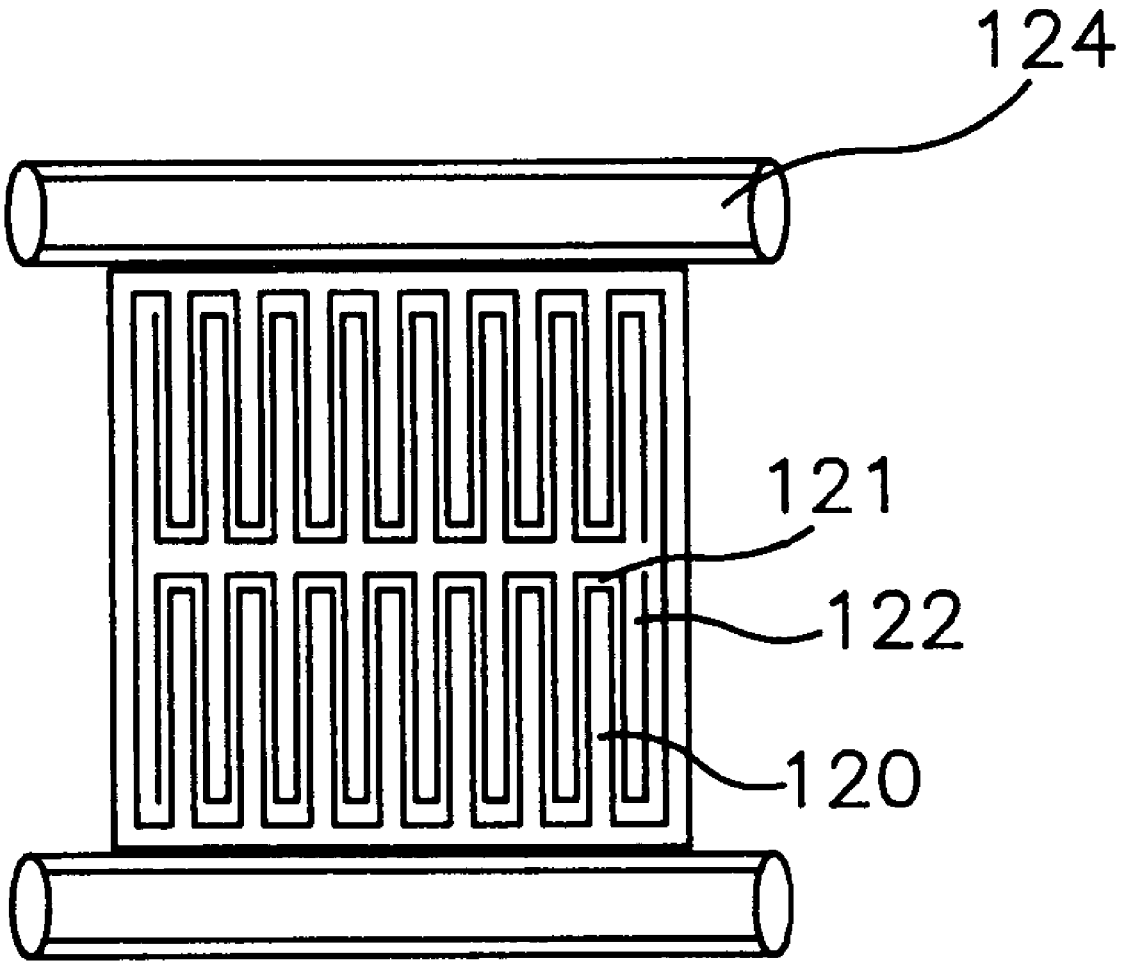

FIG. 6 is a sectional view of a first catalytic combustion unit in the embodiment shown in FIG. 5.

REFERENCE NUMERALS

A. FIG. 1

1*a* First catalytic combustion unit
2*a* Second catalytic combustion unit
3*a* Heat receiving fin
4*a* Catalyst
5*a* Electric heater
6*a* Cooling route

B. FIGS. 2–6

12 First catalyst
13 Second catalyst
14 Third catalyst
15 First heat receiving unit
16 Cooling route
19 Electric heater
20 Second heat receiving unit
101 Fuel feed unit
102 Combustion blower
103 Mixing unit
104 Combustion chamber
105 Flame hole
106 Ignition unit
107 Electric heater
108 Heat exchange fin
109 Warm water pipe
110 Temperature sensing unit
111 Circulation pump
112 Cooling heat exchanger
113 Warm water pipe
116 Purifying catalyst
117 Mixed gas hole
118 Combustion catalyst
122 First combustion catalyst

123 Second combustion catalyst
124 Second warm water pipe

PREFERRED EMBODIMENTS

Referring now to the drawings, preferred embodiments of the invention are described below.

First, the constitution of an embodiment of the invention corresponding to claims 1 to 17 is described below together with its operation by reference to FIG. 2. A liquid fuel such as kerosene or gasoline supplied from a fuel feed unit 1 is sent into a vaporization unit 4 comprising a vaporization heater 2 and a vaporization chamber 3. The vaporized gas ejected from the vaporization chamber 3 is mixed with combustion air sent from a blower 5 in a mixing unit 6. Downstream of the mixing unit 6 is provided an ejection port 7 opening radially on a taper surface of a nozzle 8. The nozzle 8 projects into a combustion chamber 9. A heat recovery unit 10 of heat of vaporization carrying the catalyst is provided in the portion of the vaporization unit 4 facing the combustion chamber 9. The inner surface of a wall 11 at the upstream side of the combustion chamber of the combustion chamber 9 is treated with a film of high radiation rate. In the case of gas fuel such as natural gas being used as the fuel, the vaporization chamber 3 is not needed, and the fuel is directly supplied into the mixing unit 6.

The combustion chamber 9 has three catalysts, first catalyst 12, second catalyst 13, and third catalyst or air permeable insulator 14. FIGS. 3*a* and 3*b* are detailed views of the first catalyst 12 and fin type first heat receiving unit 15. The first catalyst 12 is provided in the first heat receiving unit 15 consisting of 24 thin plate fins among gaps, and two sheets of the first catalyst 12 are provided in the first heat receiving unit 15. The gap between the first heat receiving unit 15 and catalyst 12, and the gap between sheets of the first catalyst 12 are kept constant by protrusions (not shown) or the like provided on the catalyst 12.

The first heat receiving unit 15 is a copper plate with corrosion resistant treatment measuring 0.5 mm in thickness, 120 mm in width and 30 mm in length in flow direction, and is soldered to a cooling route 16. The first catalyst 12 has the surface of a 0.4 mm thick heat resistant iron alloy coated with gamma-alumina, and carries platinum group metal catalyst such as platinum and palladium. At the downstream side of the first catalyst 12, a notch 17 is provided for inserting the cooling route 16. An auxiliary catalyst 18 is provided in the notch 17. The auxiliary catalyst 18 consists of multiple thin plates of heat resistant iron alloy connected into one body, or may be shaped in a slender honeycomb form. The upstream end of the fist catalyst 12 projects by 5 mm from the first heat receiving unit 15, and the downstream end, by 15 mm (see FIG. 3).

FIGS. 4*a* and 4*b* are views of the second catalyst 13 and third catalyst 14. The second catalyst 13 of honeycomb structure has a geometrical surface area of 300 cells/square inch wider than the first catalyst 12, and the thickness in flow direction is 15 mm. The honeycomb carrier is formed of cordierite or lime aluminate, and platinum group metal catalyst and gamma-alumina are supported as carrier. Honeycomb pores are squares of 0.6 mm Between the second catalyst 13 and third catalyst 14, a sheathed type electric heater 19 is provided.

The third catalyst 14 is basically designed to insulate the heat of the electric heater 19 when preheating, and it may be a honeycomb without carrying catalyst (air permeable insulator). However, when the catalyst is carried in the third catalyst 14, as mentioned later, the combustion amount in preliminary combustion can be increased, and the starting time of maximum combustion is shortened. It is also advantageous for exhaust characteristic.

Downstream of the third catalyst 14 are provided a second heat receiving unit 20 and a cooling route 21 for recovery of waste heat, and communicating with the cooling route 16, water flows inside. The generated warm water is used for supply of hot water or heating of room. Inside, instead of water, other heat medium may be used, such as refrigerant for heat pump or antifreeze. The third catalyst 14 isolates the electric heater 19 and cooling route 21 thermally. An exhaust port 22 is provided further downstream. The inner wall of the combustion chamber 9 may be covered with an insulator, or may be used as jacket of cooling water to reduce the risk by temperature rise of ambient air.

Moreover, near the downstream side of the first catalyst 12, a first temperature sensing unit 23 for detecting the temperature of the first catalyst 12 is provided, and between the first catalyst 12 and second catalyst 13, a second temperature sensing unit 24 for detecting the upstream temperature of the second catalyst 13 is provided.

The operation of this embodiment is described below. Before start of combustion, the electric heater 19 is energized. The electric heater 19 is 600 W, and heats the downstream of the second catalyst 13 and the upstream of the third catalyst 14. When the upstream temperature of the second catalyst 13 reaches 500° C., it is detected by the second temperature sensing unit 24, and supply of fuel is started. The temperature sensing unit may be installed at a position having a correlation with the catalyst temperature.

Liquid fuel is sent into the vaporization unit 4 from the fuel feed unit 1 by a pump, and is vaporized in the preheated vaporization chamber 3, and is mixed with air from the blower 5, and is ejected radially through the ejection port 7. In order to send the mixed gas uniformly in a short distance into the first catalyst 12, the nozzle 8 is preferably tapered. It is also preferred to make the concentration and flow uniform by means for turning the jet flow. The mixed gas passing through the unheated first catalyst 12 without reacting reacts with the heated second catalyst 13. Unburnt fuel is contained in the exhaust after reacting with the second catalyst 13, but since the concentration is low, it is not ignited by the electric heater 19. The exhaust containing slight unburnt fuel finishes reaction completely in the third catalyst 14. If the third catalyst 14 is a mere insulating material, unburnt fuel is discharged, though slightly, and smell is released outside of the apparatus. It is also possible to complete the reaction in the second catalyst 13 by decreasing the combustion amount, but the preliminary combustion time becomes longer.

When the upstream temperature of the second catalyst 13 reaches 600° C., power supply to the electric heater 19 is stopped. Excessive power supply is waste of electricity, and it may lead to damage to the heater. However, quick stopping is contrary to the purpose of elevating the catalyst temperature in a shorter time. The surface temperature of the electric heater 19 is preferably less than 800° C. in order to prevent ignition herein, but if ignited, when the catalyst is carried in the third catalyst 14, CO generated by the flame can be oxidized. In this state, when the reaction of the second catalyst 13 proceeds, the upstream end temperature reaches 800° C. By the radiation heat from the high temperature side at the upstream end, the downstream end of the adjacent first catalyst 12 and the auxiliary catalyst 18 are raised in temperature. If the downstream end of the first catalyst 12 is near the first heat receiving unit 15, the heat of the electric heater 19 heats the water in the cooling route. However, since the first catalyst 12 projects in the downstream direction, the temperature herein is likely to be raised by radiation heat. When the downstream side of the first catalyst 12 and the auxiliary catalyst 18 start reaction to heighten in temperature, the heat conducts upstream in the first catalyst 12 made of metal, and the upstream end of the first catalyst 12 becomes high in temperature, and, for the first time herein, the reaction is generated from the upstream end of the first catalyst 12. Preliminary combustion up to this step is done at a level lower by 2 kW than the maximum rated combustion amount. The air excess rate is 1.5.

When the upstream end temperature of the first catalyst 12 reaches 500° C. as detected by the first temperature sensing unit 23, rated combustion is possible, in which the combustion amount can be set freely in a rated range. In this state, all catalysts are in a state ready for reaction, and the fuel is supplied, for example, at 4.5 kW of maximum rated combustion amount. The air excess rate is preferred to be 1.4 to 1.8. The temperature of the entire catalyst rises. The upstream of the first catalyst 12 is 800 to 850° C., and the upstream of the second catalyst 13 is 700 to 750° C. In this state, 70 to 80% of total fuel is burnt in the first catalyst 12, and the remaining 20 to 30% is burnt in the second catalyst 13. The combustion amount in the third catalyst 14 is slight, but the smell is removed. Besides, about 70% of the reaction heat of the first catalyst 12 is transmitted to the first heat receiving unit 15 to heat the warm water. By the high temperature exhaust released from the first catalyst 12 and the reaction heat of the unburnt fuel, the second catalyst 13 maintains a temperature necessary for reaction. Since heat receiving unit is not provided in the second catalyst 13, the temperature in the third catalyst 14 is 680 to 730° C., nearly same as in the second catalyst 13. The high temperature exhaust exceeding 650° C. from the third catalyst 14 heats the water in the cooling route 21 of the second heat receiving unit 20.

The exhaust is lowered in temperature, and is discharged out of the apparatus through the exhaust port 23. In this invention, heat is exchanged through two heat receiving units, and the heat efficiency is set extremely high. Accordingly, the entire combustion apparatus should be preferably set vertical with the exhaust port down, so that water drops of dew condensed from the exhaust from the second heat receiving unit 20 may not fall on the catalyst.

In the stationary combustion state, the heat of the first catalyst 12 is transmitted to the first heat receiving unit 15 confronting parallel by radiation. If the catalyst directly contacts with the first heat receiving unit 15 which is nearly equal to the temperature of warm water, the following problems may occur. First, heat release from the first catalyst 12 is large, and the temperature is lowered too much and reaction does not occur. Second, to increase the heat generation to balance with the increase heat release amount, when the catalyst is set at high temperature and reaction is promoted, the life of the catalyst is shortened. However, since heat is transferred by radiation, such thermal instability does not occur in the invention. In this embodiment, when the temperature is higher, the heat release amount from the first catalyst 12 to the first heat receiving unit 15 is increased at the fourth power of the temperature of the first catalyst 12, and at low temperature, the radiation amount decreases suddenly at the fourth power of the temperature, so that the temperature of the first catalyst 12 is autonomically maintained within the range of reaction temperature in a range of rated combustion amount. Besides, if the first heat receiving unit 15 and first catalyst 12 are provided alternately by one piece each, heat release is excessive. This is because the face and back sides of the first catalyst 12 are cooled. When two pieces of the first catalyst 12 are provided in the first heat receiving unit 15, the mutually confronting surfaces of catalysts are formed, and excessive heat release is prevented, so that the catalyst temperature is stabilized.

The upstream end of the first catalyst 12 projects from the upstream end of the first heat receiving unit 15. When the same position is set at the foremost end in the upstream direction, herein, heat release is discharged as radiation heat in the upstream direction space, and it is also radiated to the first heat receiving unit 15, so that the temperature is likely to decline, and in particular, by low combustion amount, the temperature herein is likely to be lower than the reaction temperature. However, when projected as in the invention, all pieces of the first catalyst 1 confront parallel, and therefore the temperature is not lowered.

When using a liquid fuel, heat for vaporizing it is necessary. When starting combustion, electric heat must be used for vaporizing, but in stationary combustion, electricity is too expensive. Accordingly, during combustion, the conduction heat of the combustion chamber upstream wall 11 receiving radiation at the upstream end of the first catalyst 12 and part of reaction heat of the fuel in the heat recovery unit 10 carrying the catalyst are transmitted to the vaporization unit 4. The vaporization heater 2 is for auxiliary purpose during stationary combustion.

The temperature of the first catalyst 12 is almost uniform in the direction of horizontal section, but is slightly lower near the middle cooling route 16. In the periphery of the area with a tendency of temperature decline, however, since it is remote from the cooling route 16, high temperature is maintained. Temperature drop in the middle may lead to increase of non-reaction amount in the middle, but the auxiliary catalyst 18 provided downstream of the first catalyst 12 compensates for this reaction drop. This is because the auxiliary catalyst 18 is designed to be free from cooling effect of the first heat receiving unit and is high in temperature.

The situation of adjustment of the combustion amount is explained. When the combustion amount is lowered to 2 kW, the temperature of the first catalyst 12 drops to 600 to 650° C., and the second catalyst 13, to 550 to 600° C. by the drop of the supplied fuel amount, the balance of heat generation and heat release is shifted to lower temperature side. Yet, the both catalysts are over the reaction temperature, and combustion continues normally. However, when the fuel supply is further lowered to 1 kW, the temperature of the first catalyst 12 decreases suddenly to 300° C. below the activation temperature, and reaction hardly occurs. This is because the first catalyst 12 is cooled by the first heat receiving unit 15, and heat release is excessive. However, the second catalyst 13 hardly releases heat, and the temperature is kept at 800° C., and the whole fuel is burned herein. Even at 0.5 kW, the second catalyst 13 maintains 650° C. and burns completely. The temperature of the second catalyst 13 is less influenced by the fuel feed amount because the fuel of higher concentration enters the second catalyst 13 when the reaction of the first catalyst cooled in low combustion is lowered more. The second catalyst 13 is not cooled, and therefore high temperature is maintained even at low combustion amount.

In the combustion by the second catalyst 13 of honeycomb structure only, a high air excess rate is advantageous. The air excess rate is 1.8 to 2.5. In the honeycomb structure, since heat release is small, the temperature is not lowered at high air excess rate, and the reactivity is higher at higher oxygen partial pressure. As a result, the combustion amount adjusting width is ⅕.

From this state of low combustion amount, it is impossible to return to maximum rating suddenly. This is because the first catalyst 12 is below the reaction temperature. Same as in preliminary combustion, by burning at 2 kW, when the first catalyst 12 has reached the specified activation temperature as detected by the first temperature sensing unit 23, it can be returned to maximum rated combustion amount. In this case, too, the downstream end of the first catalyst 12 must project toward the second catalyst 13 from the downstream end of the first heat receiving unit 15. Otherwise, the heat of the second catalyst 13 is not transmitted promptly to the first catalyst 1.

Next, an embodiment of the invention is described below while referring to FIG. 5 and FIG. 6. As shown in FIG. 5, the fuel gas supplied from a fuel feed unit 101 and combustion air sent from a combustion blower 102 are mixed in a mixing unit 103, and a mixed gas is prepared. The mixed gas flows into a first catalytic combustion unit 119 provided downstream of the mixing unit 103, and reacts with a first catalyst 122 in the first catalytic combustion unit 119. That is, as seen from FIG. 6 showing the section of the first catalytic combustion unit 119, the mixed gas reacts in the first catalyst 122 in a thin plate form provided in a heat receiving fin 120 projecting inside of the first catalytic combustion unit 119 through a gap 121. On the outer circumference of the first catalytic combustion unit 119 made of aluminum alloy, a first warm water pipe 124 is provided to recover heat. The first catalyst 122 is a heat resistant iron alloy coated with gamma-alumina, and platinum group catalyst such as platinum or palladium is carried therein. A second catalytic combustion unit is provided downstream of the first catalytic combustion unit 119, and a second catalyst 123 of honeycomb structure is provided therein. An electric heater is provided between the first catalytic combustion unit 119 and the second catalytic combustion unit 123. An electric heater may be also provided upstream of the first catalytic combustion unit 119 to cooperate. The inner wall of the second catalyst 123 is lined with an insulating material.

Downstream of the second catalyst 123, a fin 108 and a second warm water pipe 109 for recovery of waste heat are provided to communicate with the first warm water pipe 124.

In such constitution, the operation of the invention is described below. The electric heater 107 is energized to heat the first catalyst 122 and second catalyst 123 simultaneously, and preheating of catalyst is started. The downstream side of the first catalyst 122 and the upstream side of the second catalyst 123 are heated. When the catalysts 122, 123 reach specified activation temperature, power supply to the electric heater 107 is stopped, and supply of fuel is started. The mixed gas sent from the mixing unit 103 passes through the first catalytic combustion unit 119. The activation temperature varies with the kind of fuel or catalyst, and it is about 300° C., for example, in propane, and it is higher in methane, and lower in kerosene. To heat the catalyst to the activation temperature, the surface temperature of the electric heater is preferred to be over 600° C.

The mixed gas first reacts partly in the downstream area of the first catalyst 122, and the nonreacted fuel passing through the first catalyst 122 begins to react in the upstream area of the second catalyst 123. Since the second catalyst 123 is high in temperature, the nonreacted gas reacts herein, and the final exhaust hardly contains nonreacted gas.

In the first catalyst 122, the catalyst adsorbs gas and oxygen, and since reaction takes place on the catalyst surface, combustion is free from flame, and the first catalyst 122 is heated to high temperature by the combustion heat, and this heat passes through the gap 121 as radiation heat and is transmitted to the fin 121. Herein, 745% of the energy of the supplied fuel is burnt in the first catalytic combustion unit 119, and 80% of the burnt energy transmits heat from the fin 20 to the first warm water pipe 124. That is, 60% (=75×80%) of the supplied fuel energy is transmitted to the water. The exhaust discharged from the first catalytic combustion unit 119 contains 25% of unburnt fuel of 100% of supplied fuel energy (=100%−75%) and 15% of exhaust heat (=75%−60%), totaling to 40%. When the temperature of the second catalyst 123 drops, the unburnt fuel hardly reacts, and therefore heat is not exchanged at this step. Hence, the exhaust from the second catalyst 123 after burning all unburnt fuel contains 40% of the supplied energy as exhaust heat. Consequently, this heat is recovered by the second warm water pipe 109 having the fin 108. At this step, the heat exchange rate was 70%. The heat recovered by the second warm water pipe 109 is 29% (=40% ×70%). That is, totaling the first warm water pipe 124 and second warm water pipe 109, the overall efficiency was 88% (=60%+28%).

If the catalytic combustion apparatus is operated at the same combustion load factor (the combustion amount per unit volume of combustion chamber) as in the flame combustion apparatus, the catalyst temperature exceeds 1200° C., and the heat resistant life of the catalyst is lowered extremely. Therefore, a large catalyst is used in embodiment 4. In this embodiment, however, since the fin 120 used as the heat exchanger is directly covered with the catalyst, the first catalyst 122 is relatively low in temperature, and the heat generated in the catalyst is directly transmitted to the heat receiving unit, so that the heat exchange efficiency is high.

In this embodiment, too, when the heating load decreases and the warm water temperature rises too much, the fuel feed amount must be decreased. The lower limit of combustion is 2 kW when the catalyst becomes lower than the activation temperature. At this point, combustion is stopped, and the electric heater 107 is energized again, and the warm water is heated. Since the electric heater can be controlled from 2 kW to 0, it is possible to cope with large fluctuations of the heating load. However, as far as the activation temperature of the catalyst of re-combustion is maintained, combustion can be resumed any time, and it is possible to cope with sudden rise of heating load. If under the activation temperature, by setting a short preheating time by energizing again, the clean exhaust in re-combustion is not spoiled.

The changeover control of combustion and electricity in embodiments 1 to 4 may be selected depending on application by detecting the ambient temperature, room temperature, or warm water temperature.

The invention described herein has the following effects. In the catalytic combustion apparatus featuring low NOx and flame-free combustion, the following effects are brought about.

1. When starting combustion, the electric power for preheating the catalyst is saved.

2. It is possible to solve the problems of deterioration due to high temperature of the middle of the first catalyst, increase of nonreacted amount due to drop of peripheral temperature, and abnormal high temperature caused by reaction of this nonreacted portion in the second catalyst.

3. The combustion amount can be adjusted in wide range.

The invention also realizes a heating apparatus flexible to large fluctuations of the heating load, is capable of generating a high output in combustion when starting heating or when the ambient temperature is low, and heating by electric heat when the heating load is low.

Moreover, the exhaust upon ignition in combustion is clean, and adverse effects of combustion are decreased.

In addition, in catalytic combustion, the preheating power source of catalysts can be shared, and the low NOx effect is also obtained.

What is claimed is:

1. A combustion apparatus comprising a fuel feed unit, a blower for supplying combustion air, a mixing unit for fuel and combustion air, a first catalyst provided downstream of the mixing unit, a first heat receiving unit adjacent to the first catalyst, a second catalyst with a larger geometrical surface area than that of the first catalyst provided downstream in the flow direction of the first catalyst, an electric heater for heating the catalyst provided downstream of the second catalyst, an air permeable insulator provided downstream of the electric heater, and a second heat receiving unit provided downstream of the air permeable insulator, wherein power is supplied to the electric heater when starting combustion to heat the second catalyst over the reaction temperature of catalyst, a mixed gas of fuel and air is fed to start catalytic combustion of second catalyst, the downstream portion in flow direction of the first catalyst is heated over the reaction temperature of catalyst by the combustion heat of the second catalyst, and combustion is started by the first catalyst.

2. A combustion apparatus of claim 1, wherein the air permeable insulator carries catalyst.

3. A combustion apparatus of claim 1, wherein the power supply to the electric heater is stopped when the second catalyst reaches a specified temperature after supply of fuel.

4. A combustion apparatus of claim 1, wherein the fuel supply amount is smaller than the rated combustion amount until the temperature of the first catalyst reaches a specified temperature.

5. A combustion apparatus, adjacent to the first catalyst, and a second catalyst with a larger geometrical surface area than that of the first catalyst provided downstream in the flow direction of the first catalyst, wherein the heat receiving unit is composed of multiple fins and a cooling route penetrating through the fins, and the first catalyst is disposed substantially parallel among the fins.

6. A combustion apparatus of claim 5, wherein two or more pieces of the first catalyst are disposed among fins.

7. A combustion apparatus of claim 5, wherein a notch for inserting into the cooling route provided at the downstream side of the first catalyst.

8. A combustion apparatus of claim 5, wherein an auxiliary catalyst is provided in the notch.

9. A combustion apparatus comprising a fuel feed unit, a blower for supplying combustion air, a mixing unit of fuel and combustion air, a first catalyst provided downstream of the mixing unit, a heat receiving unit adjacent to the first catalyst, and a second catalyst with a larger geometrical surface area than that of the first catalyst provided downstream in the flow direction of the first catalyst, wherein the first catalyst is substantially responsible for combustion in high combustion amount, and the second catalyst is substantially responsible for combustion in low combustion amount.

10. A combustion apparatus of claim 9, wherein the air excess rate in high combustion is smaller than the air excess rate in low combustion.

11. A combustion apparatus of claim 9, wherein the combustion amount is increased through an intermediate combustion amount region when changing over the combustion amount from low combustion amount to high combustion amount.

12. A combustion apparatus according to claim 1 wherein the downstream end of the first catalyst projects toward the second catalyst more than the downstream end of the heat receiving unit.

13. A combustion apparatus according to claim 1, wherein the flow direction upstream end of the first catalyst projects in the upstream direction more than the upstream end of the heat receiving unit.

14. A combustion apparatus of claim 1, wherein the first catalyst, second catalyst, second heat receiving unit, and exhaust port are arranged vertically, and the exhaust port is set downward.

15. A combustion apparatus according to claim 1, further comprising a vaporization unit for liquid fuel connected integrally or thermally to the radiation heat receiving surface confronting the upstream side of the first catalyst.

16. A combustion apparatus according to claim 1, wherein a nozzle having ejection holes arranged radially is disposed in the upstream space of the first catalyst.

17. A combustion apparatus of claim 16, wherein the ejection holes are arranged on the taper surface of the nozzle.

18. A combustion apparatus according to claim 1, wherein the heat receiving unit is heated by the heat generated by the electric heater when the required heating amount is small, and the air premeable insulator is heated by catalytic combustion by the catalyst after feeding power to the electric heater when the heating amount is large.

19. A combustion apparatus according to claim 1, wherein the electric heater is energized and no fuel is supplied when the heating amount is small and the electric heater is energized and fuel is supplied to burn at the catalyst when the heating requirement is larger, thereby heating the air premeable insulator.

20. A combustion apparatus according to claim 9, wherein the downstream end of the first catalyst projects toward the second catalyst more than the downstream end of the heat receiving unit.

21. A combustion apparatus according to claim 5, wherein the flow direction upstream end of the first catalyst projects in the upstream direction more than the upstream end of the heat receiving unit.

22. A combustion apparatus according to claim 5, further comprising a vaporization unit for liquid fuel connected integrally or thermally to the radiation heat receiving surface confronting to the upstream side of the first catalyst.

23. A combustion apparatus according to claim 5, wherein a nozzle having ejection holes arranged radially is disposed in the upstream space of the first catalyst.

24. A combustion apparatus according to claim 5, wherein the heat receiving unit is heated by the heat generated by the electric heater when the heating amount is small, and the heat receiving unit is heated by catalytic combustion after feeding power to the electric heater when the heating amount is large.

25. A combustion apparatus according to claim 5, wherein the electric heater is energized and no fuel is supplied when the heating amount is small, and the electric heater is energized and fuel is supplied to burn at the catalyst when the heating requirement is larger, thereby heating the second catalyst.

26. A combustion apparatus according to claim 9, wherein the flow direction upstream end of the first catalyst projects in the upstream direction more than the upstream end of the heat receiving unit.

27. A combustion apparatus according to claim 9, further comprising a vaporization unit of liquid fuel connected integrally or thermally to the radiation heat receiving surface confronting to the upstream side of the first catalyst.

28. A combustion apparatus according to claim 9, wherein a nozzle having ejection holes arranged radially is disposed in the upstream space of the first catalyst.

29. A combustion apparatus according to claim 9, wherein the heat receiving unit is heated by the heat generated by the electric heater when the heating amount is small, and the heat receiving unit is heated by catalytic combustion after feeding power to the electric heater when the heating amount is large.

30. A combustion apparatus according to claim 9, wherein the electric heater is energized and no fuel is supplied when the heating amount is small and the electric heater is energized and fuel is supplied to burn at the catalyst when the heating requirement is larger, thereby heating the heat receiving unit.

* * * * *